US006637963B2

(12) United States Patent
Huang

(10) Patent No.: US 6,637,963 B2
(45) Date of Patent: Oct. 28, 2003

(54) MULTI-PURPOSE PEN-SHAPED CONTAINER

(76) Inventor: Tao-Chen Huang, No. 30, Lane 120, Chang-Lu Rd., Chang-Hua City (TW)

( * ) Notice: Subject to any disclaimer, the term of this patent is extended or adjusted under 35 U.S.C. 154(b) by 0 days.

(21) Appl. No.: 10/151,828

(22) Filed: May 22, 2002

(65) Prior Publication Data

US 2003/0152410 A1 Aug. 14, 2003

(30) Foreign Application Priority Data

Feb. 8, 2002 (TW) ..... 91201781 U

(51) Int. Cl.[7] ..... B43K 27/02

(52) U.S. Cl. ..... 401/19; 401/18; 401/17; 132/317; 132/314; 132/316

(58) Field of Search ..... 401/18, 17, 19, 401/16, 23, 24, 25, 34; 132/317, 313, 314, 316

(56) References Cited

U.S. PATENT DOCUMENTS 2,724,850 A * 11/1955 Howard et al. ..... 401/17
3,592,202 A * 7/1971 Jones ..... 132/88.7
5,860,755 A * 1/1999 Bunk ..... 401/52
6,200,045 B1 * 3/2001 Hahn et al. ..... 401/18

* cited by examiner

*Primary Examiner*—David J. Walczak
(74) *Attorney, Agent, or Firm*—Lowe Hauptman Gilman & Berner, LLP

(57) ABSTRACT

A multi-purpose pen-shaped container includes first and second receptacle bodies, an applicator device, an end cap, and a coupling unit. Each receptacle body has an axis, first and second end portions, and a peripheral wall that is disposed to surround the axis so as to define a receiving chamber. The first and second end portions of each receptacle body are formed with a coupling member and a connecting member, respectively. The applicator device has a base portion that engages the connecting member on the first receptacle body. The end cap has a tubular cap wall that cooperates with the base portion of the applicator device to define a receiving space for receiving a cosmetic applicator therein. The coupling unit engages removably the coupling members of the first and second receptacle bodies.

7 Claims, 8 Drawing Sheets

MULTI-PURPOSE PEN-SHAPED CONTAINER

CROSS-REFERENCE TO RELATED APPLICATION

This application claims priority of Taiwan Patent Application No. 91201781, filed on Feb. 8, 2002.

BACKGROUND OF THE INVENTION

1. Field of the Invention

The invention relates to a container, more particularly to a multi-purpose pen-shaped container.

2. Description of the Related Art

Generally, a woman carries a small cosmetic pouch that contains cosmetic products, such as lipstick, eye shadow, lip gloss, perfume, etc., in her bag so that she can retouch her make-up when desired. These cosmetic products are usually individually packed in small bottles and containers. However, since these small bottles and containers are not orderly disposed in the pouch, it is not easy for the user to retrieve the desired cosmetic product in a rush. Furthermore, in view of their small size, these bottles and containers are difficult to handle when applying make-up.

SUMMARY OF THE INVENTION

Therefore, the main object of the present invention is to provide a multi-purpose pen-shaped container that is convenient to carry, use, and store.

According to this invention, a multi-purpose pen-shaped container comprises an elongate first receptacle body, a first applicator device, an elongate first end cap, an elongate second receptacle body, and a coupling unit. The elongate first receptacle body has a first receptacle axis, first and second end portions opposite to each other along the first receptacle axis, and a peripheral wall that extends between the first and second end portions and that is disposed to surround the first receptacle axis so as to define a first receiving chamber. The first end portion is a closed end portion, and has an outer surface formed with a first coupling member. The second end portion is an open end portion that permits access into the first receiving chamber, and has an outer surface formed with a first connecting member. The first applicator device has a base portion formed with a second connecting member to engage the first connecting member such that the base portion of the first applicator device closes the second end portion of the first receptacle body. A first cosmetic applicator is mounted on the base portion. The elongate first end cap has a tubular cap wall that is capped removably on and that cooperates with the base portion of the first applicator device to define a first receiving space for receiving the first cosmetic applicator therein. The elongate second receptacle body has a second receptacle axis, first and second end portions opposite to each other along the second receptacle axis, and a peripheral wall that extends between the first and second end portions of the second receptacle body and that is disposed to surround the second receptacle axis so as to define a second receiving chamber. The first end portion of the second receptacle body has an outer surface formed with a second coupling member. The coupling unit is disposed to surround the first end portions of the first and second receptacle bodies, and is formed with a third coupling member to engage removably the first and second coupling members such that the first receptacle axis is brought into alignment with the second receptacle axis.

Preferably, the multi-purpose pen-shaped container of the present invention further comprises a second applicator device mounted on the second receptacle body, and an elongate second end cap capped removably on the second applicator device.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
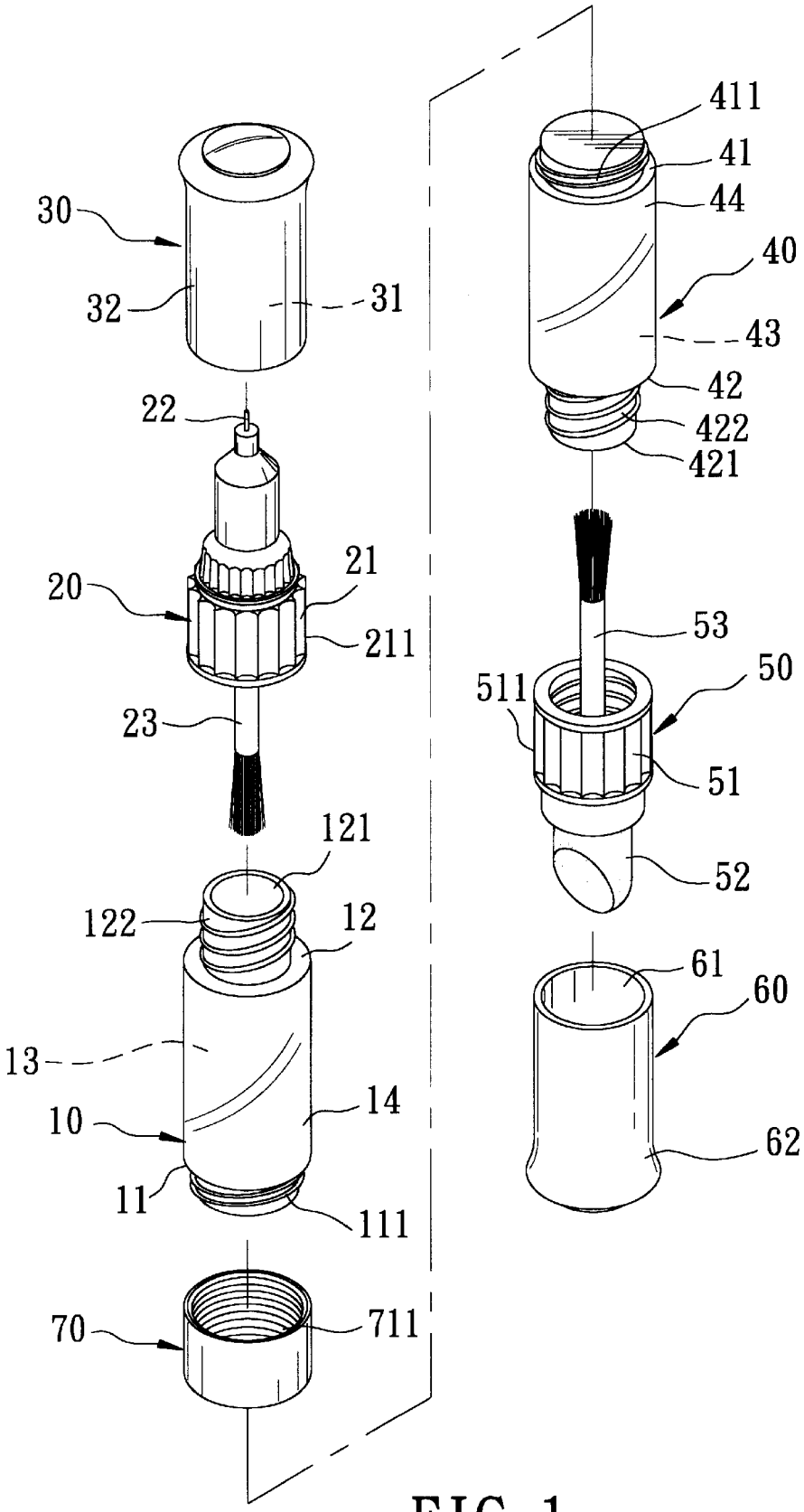
FIG. 1 is an exploded perspective view of the first preferred embodiment of a multi-purpose pen-shaped container according to the present invention.

Before the present invention is described in greater detail, it should be noted that like elements are denoted by the same reference numerals throughout the disclosure.

Figure 2:
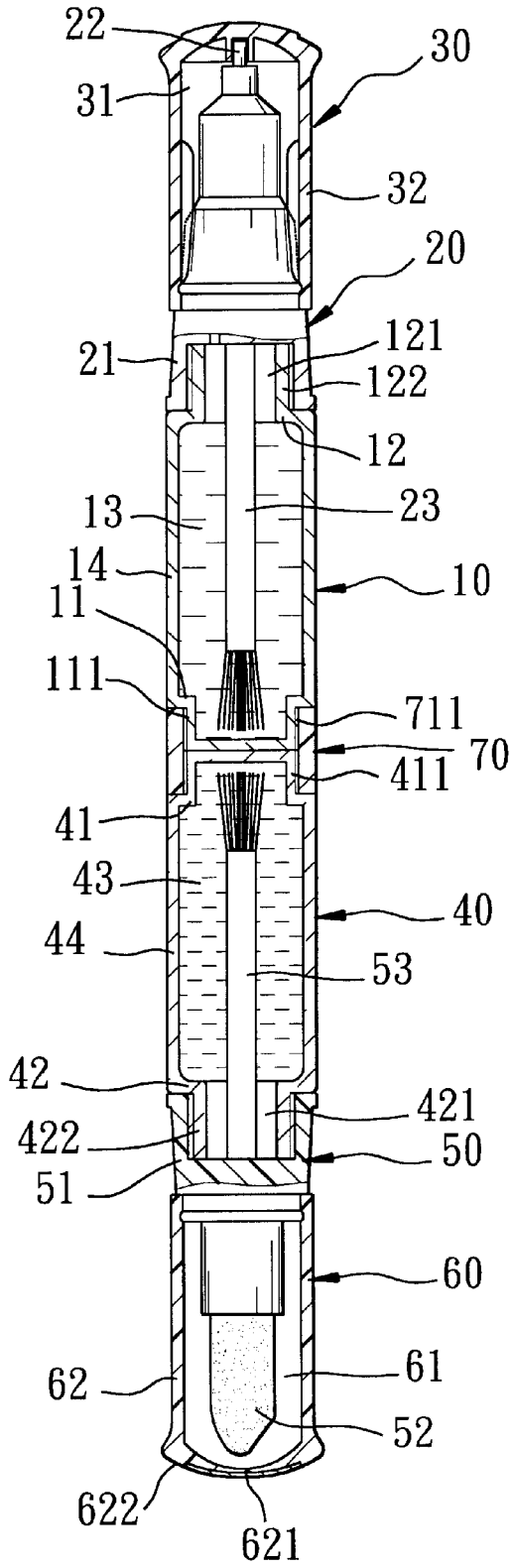
FIG. 2 is an assembled sectional schematic view of the first preferred embodiment.

Referring to FIGS. 1 and 2, the first preferred embodiment of a multi-purpose pen-shaped container according to the present invention is shown to comprise an elongate first receptacle body 10, a first applicator device 20, an elongate first end cap 30, an elongate second receptacle body 40, a coupling unit 70, a second applicator device 50, and an elongate second end cap 60.

The elongate first receptacle body 10 has a first receptacle axis, first and second end portions 11, 12 opposite to each other along the first receptacle axis, and a peripheral wall 14 that extends between the first and second end portions 11, 12 and that is disposed to surround the first receptacle axis so as to define a first receiving chamber 13. The first end portion 11 is a closed end portion, and has an outer surface formed with a first coupling member 111, which is in the form of an external screw thread. The second end portion 12 is an open end portion 121 that permits access into the first receiving chamber 13, and has an outer surface formed with an externally threaded first connecting member 122.

The first applicator device 20 has a base portion 21 formed with a second connecting member 211 to engage the first connecting member 122 such that the base portion 21 closes the second end portion 12 of the first receptacle body 10. A first cosmetic applicator is mounted on the base portion 21 opposite to the second connecting member 211. In this embodiment, the first cosmetic applicator is a stylus nib 22. The first applicator device 20 further includes a third cosmetic applicator that is mounted on the base portion 21, and that extends into the first receiving chamber 13. In this embodiment, the third cosmetic applicator is a first brush applicator 23 that is in fluid communication with the stylus nib 22.

The elongate first end cap 30 has a tubular cap wall 32 that is capped removably on and that cooperates with the base portion 21 of the first applicator device 20 to define a first receiving space 31 for receiving the stylus nib 22 therein.

The elongate second receptacle body 40 has a second receptacle axis, first and second end portions 41, 42 opposite to each other along the second receptacle axis, and a peripheral wall 44 that extends between the first and second end portions 41, 42 and that is disposed to surround the second receptacle axis so as to define a second receiving chamber 43. The first end portion 41 is a closed end portion, and has an outer surface formed with a second coupling member 411, which is in the form of an external screw thread. The second end portion 42 is an open end portion 421 that permits access into the second receiving chamber 43, and has an outer surface formed with an externally threaded third connecting member 422.

The coupling unit 70 is disposed to surround the first end portions 11, 41 of the first and second receptacle bodies 10, 40, and is formed with a third coupling member 711, which is in the form of an internal screw thread, to engage removably the external screw threads of the first and second coupling members 111, 411 such that the first receptacle axis is brought into alignment with the second receptacle axis.

The second applicator device 50 has a base portion 51 formed with a fourth connecting member 511 to engage the third connecting member 422 such that the base portion 51 closes the second end portion 42 of the second receptacle body 40. A second cosmetic applicator is mounted on the base portion 51. In this embodiment, the second cosmetic applicator is a lipstick 52. The second applicator device 50 further includes a third cosmetic applicator that is mounted on the base portion 51, and that extends into the second receiving chamber 43. In this embodiment, the third cosmetic applicator is a second brush applicator 53.

The elongate second end cap 60 has a tubular cap wall 62 that is capped removably on and that cooperates with the base portion 51 of the second applicator device 50 to define a second receiving space 61 for receiving the lipstick 52 therein. The cap wall 62 has an end wall 622 with a mirror 621 mounted thereon.

During assembly, after the coupling unit 70 engages the first and second coupling members 111, 411 of the first and second receptacle bodies 10, 40, the first and second connecting members 122, 211 and the third and fourth connecting members 422, 511 are threadedly connected to each other, respectively. At this time, the first and second brush applicators 23, 53 extend into the first and second receiving chambers 13, 43, respectively. The first and second end caps 30, 60 are then mounted on the base portion 21, 51 of the respective one of the first and second applicator devices 20, 50 such that the stylus nib 22 and the lipstick 52 are disposed respectively in the first and second receiving spaces 31, 61. The assembly as such forms a multi-purpose pen-shaped container, as best illustrated in FIG. 2. It should be noted that more than two coupling units 70 can be used to connect a plurality of receptacle bodies 10, 40.

Figure 3:
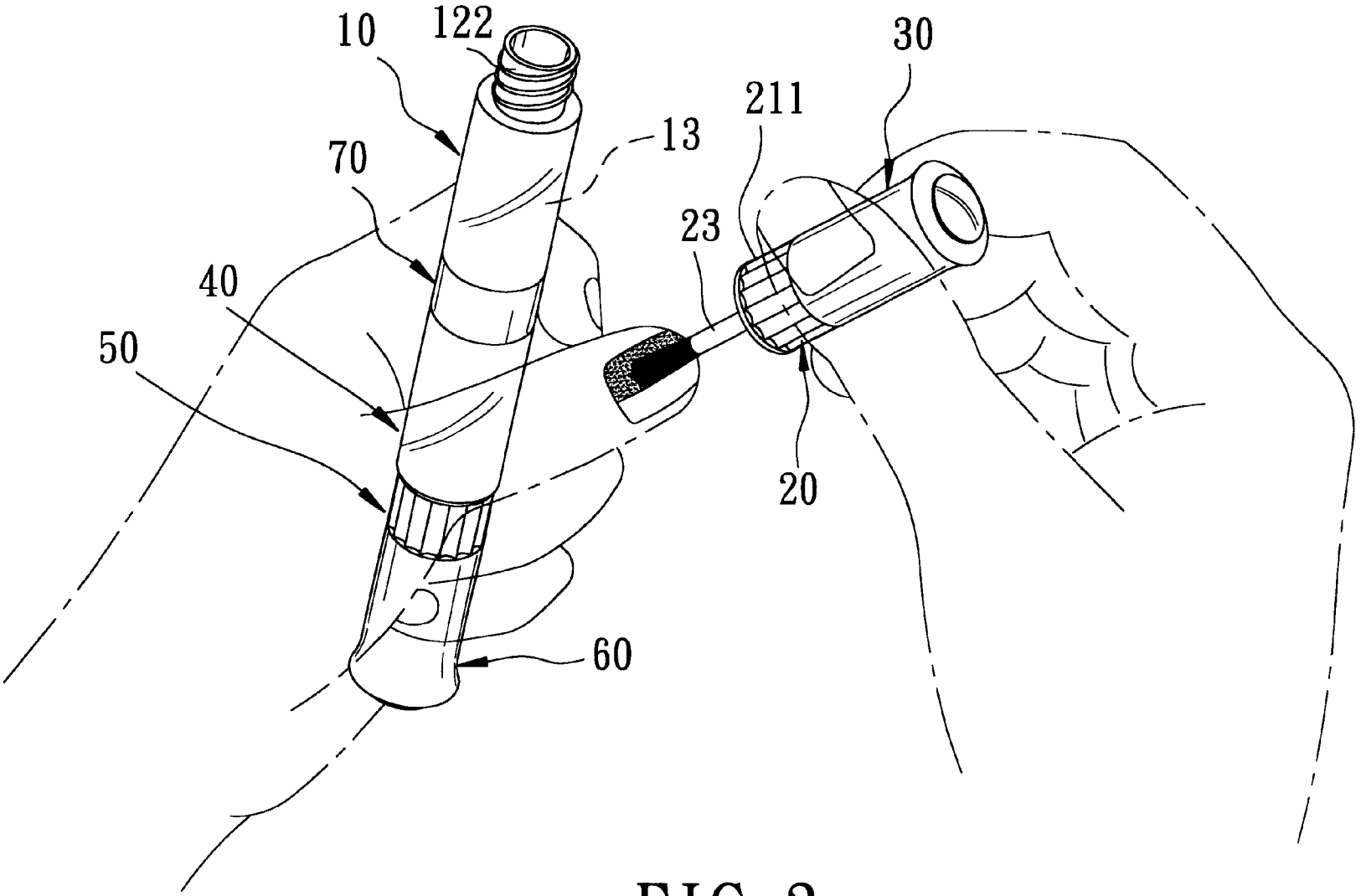
FIG. 3 illustrates the first preferred embodiment in a state of use.

In use, the first receiving chamber 13 in this embodiment may be filled with nail polish. With one hand grasping a longer holding part formed by the interconnected first and second receptacle bodies 10, 40, the coupling unit 70, the second applicator device 50, and the second end cap 60, and with the other hand holding the first end cap 30, the first applicator device 20 can be rotated relative to the first receptacle body 10 to separate the second connecting member 211 from the first connecting member 122, thereby permitting removal of the first brush applicator 23 from the first receiving chamber 13. Nail polish can be coated on a fingernail at this time, as best illustrated in FIG. 3.

Figure 4:
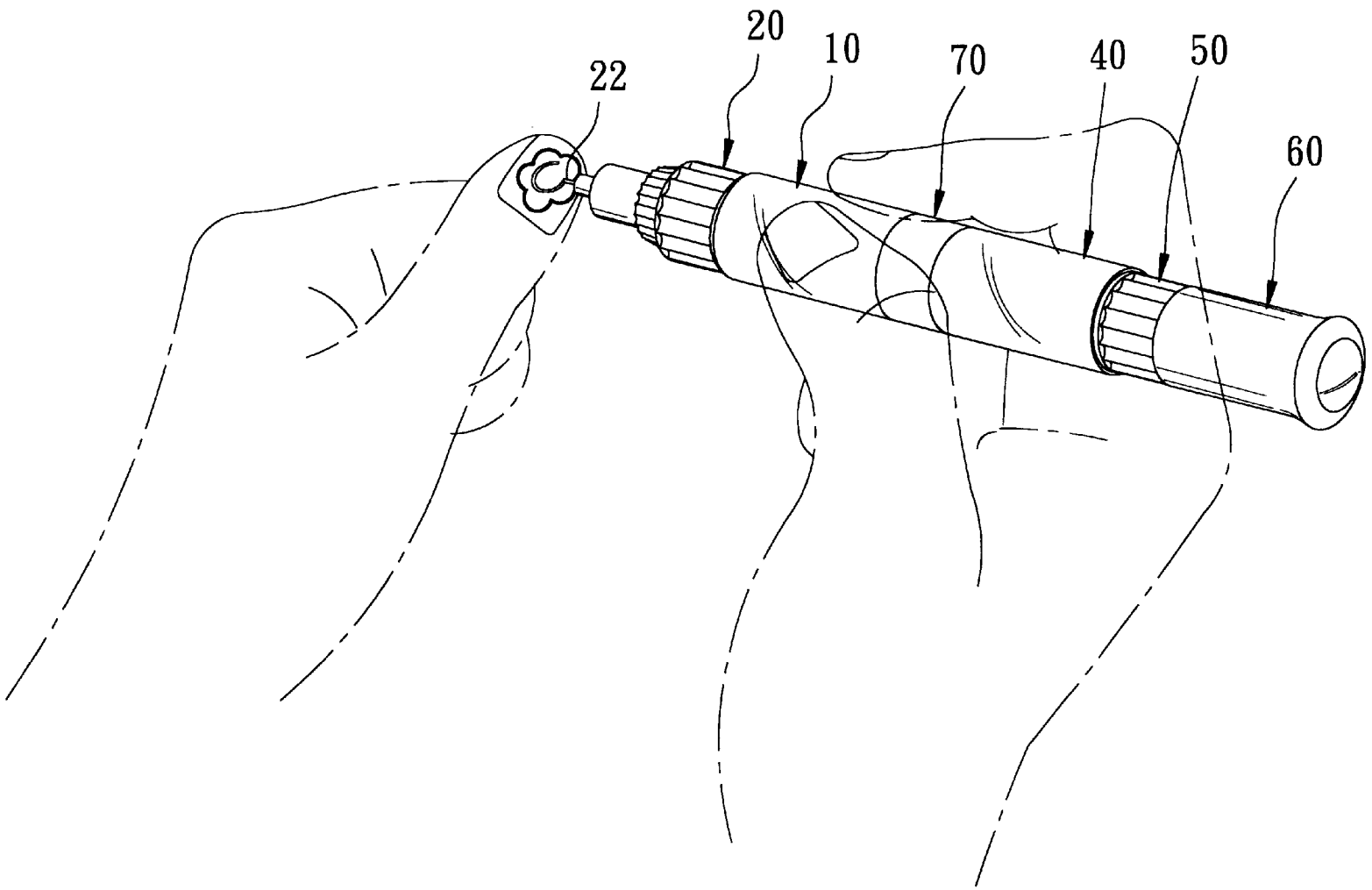
FIG. 4 illustrates the first preferred embodiment in another state of use.

Referring to FIG. 4, with one hand grasping a longer holding part formed by the interconnected first and second receptacle bodies 10, 40, the coupling unit 70, the second applicator device 50, and the second end cap 60, the other hand can be used to remove the first end cap 30 from the first applicator device 20 so as to expose the stylus nib 22. Since the stylus nib 22 is in fluid communication with the first brush applicator 23, the nail polish flows through the first brush applicator 23, and flows out of the stylus nib 22 such that painting can be done on the fingernail, as best illustrated in FIG. 4.

Figure 5:
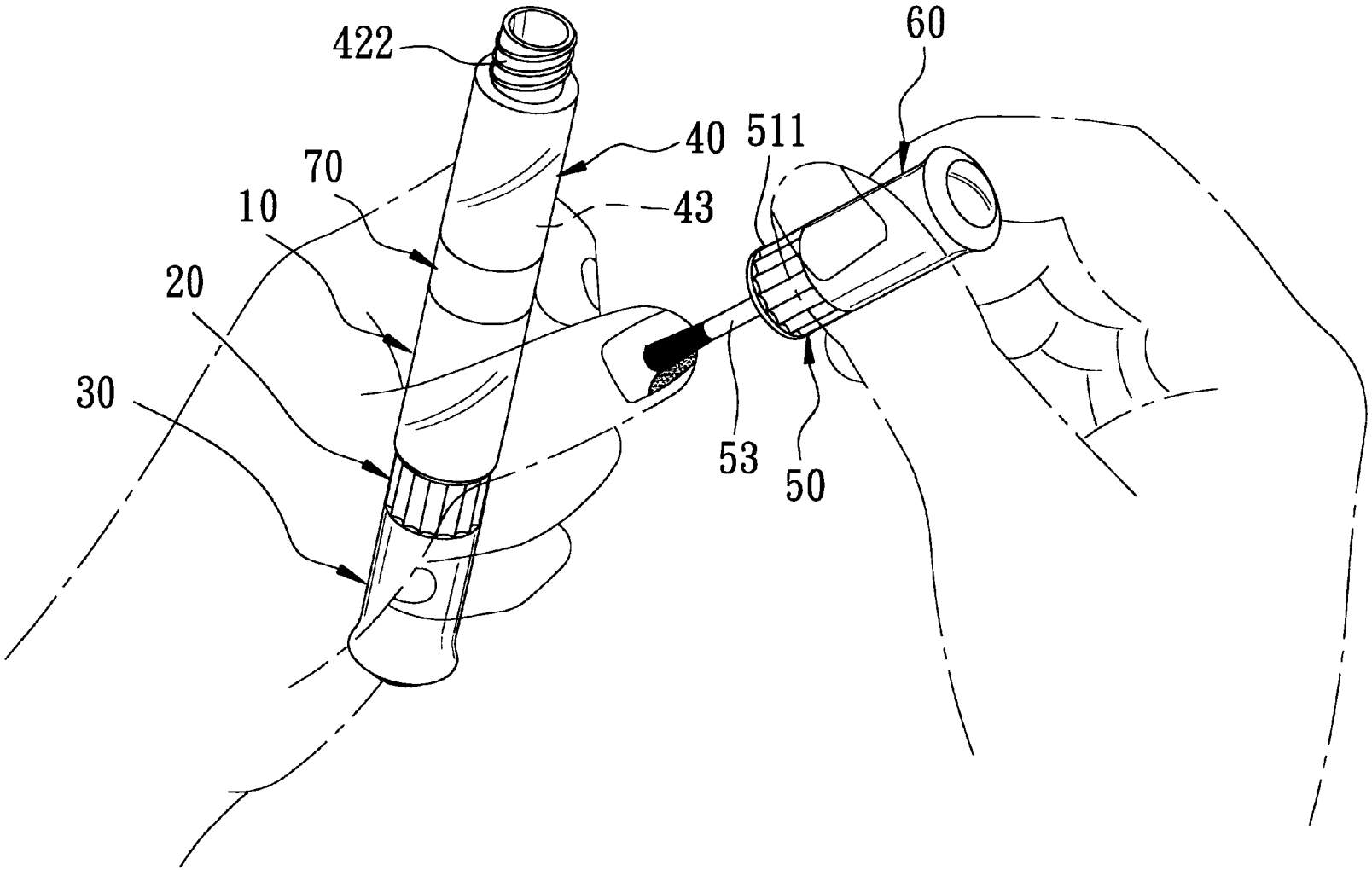
FIG. 5 illustrates the first preferred embodiment in a yet another state of use.

The second receiving chamber 43 in this embodiment is filled with polish remover. With one hand grasping a longer holding part formed by the interconnected first and second receptacle bodies 10, 40, the coupling unit 70, the first applicator device 20, and the first end cap 30, and with the other hand holding the second end cap 60, the second applicator device 50 can be rotated relative to the second receptacle body 40 to separate the fourth connecting member 511 from the third connecting member 422, thereby permitting removal of the second brush applicator 53 from the second receiving chamber 43. Polish remover can then be applied on the fingernail so as to remove or repair the nail polish, as best illustrated in FIG. 5.

Figure 6:
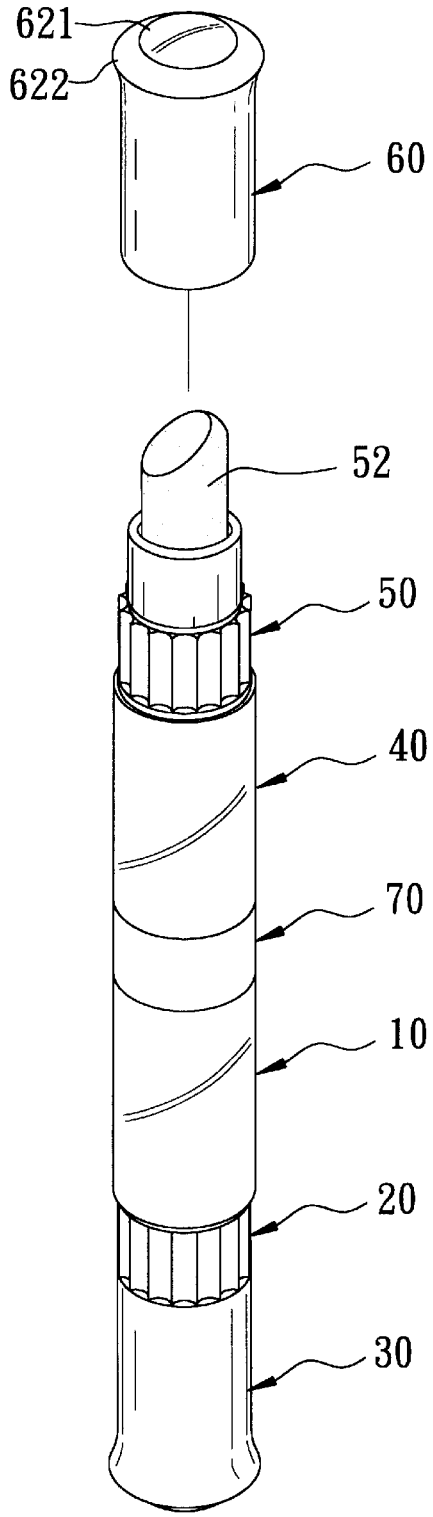
FIG. 6 illustrates how a first end cap of the first preferred embodiment can be removed by force to reveal a lipstick for use.

Referring to FIG. 6, with one hand grasping a longer holding part formed by the interconnected first and second receptacle bodies 10, 40, the coupling unit 70, the first applicator device 20, and the first end cap 30, the other hand can be used to remove the second end cap 60 from the second applicator device 50 so as to expose the lipstick 52. The lipstick 52 can be applied on the lips using the mirror 621 on the end wall 622 of the second end cap 60.

Figure 7:
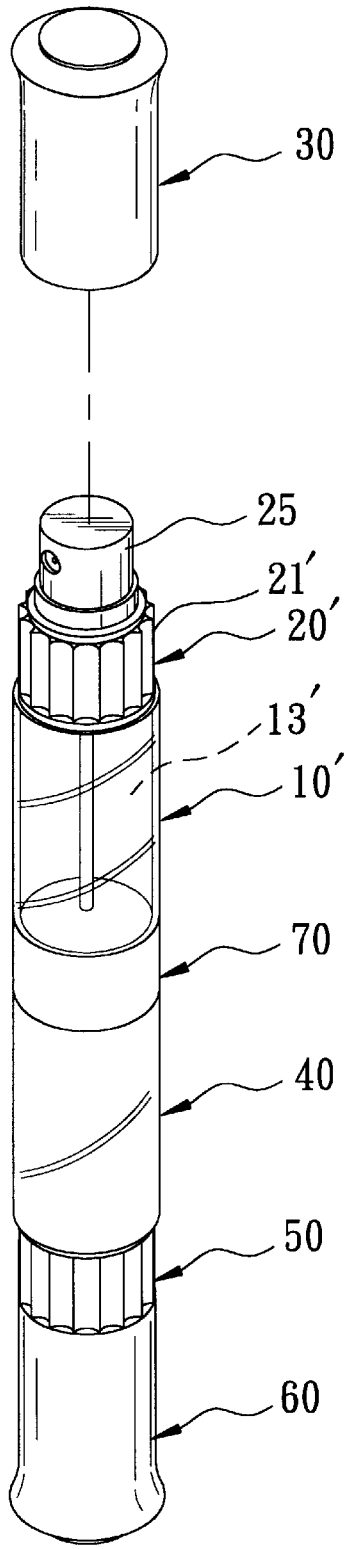
FIG. 7 is an assembled perspective view of the second preferred embodiment of a multi-purpose pen-shaped container according to the present invention.

The second preferred embodiment of a multi-purpose pen-shaped container according to the present invention is shown in FIG. 7 to be substantially similar to the first preferred embodiment. Unlike the first preferred embodiment, the first receiving chamber 13' in the first receptacle body 10' is filled with perfume, and an atomizer 25 is mounted on the base portion 21' of the first applicator device 20'. The atomizer 25 is in fluid communication with the first receiving chamber 13'.

The second preferred embodiment is used in a manner substantially similar to the first preferred embodiment. Particularly, with one hand grasping a longer holding part formed by the interconnected first and second receptacle bodies 10', 40, the coupling unit 70, the second applicator device 50, and the second end cap 60, the other hand can be used to remove the first end cap 30 from the first applicator device 20' so as to expose the atomizer 25 for use.

Figure 8:
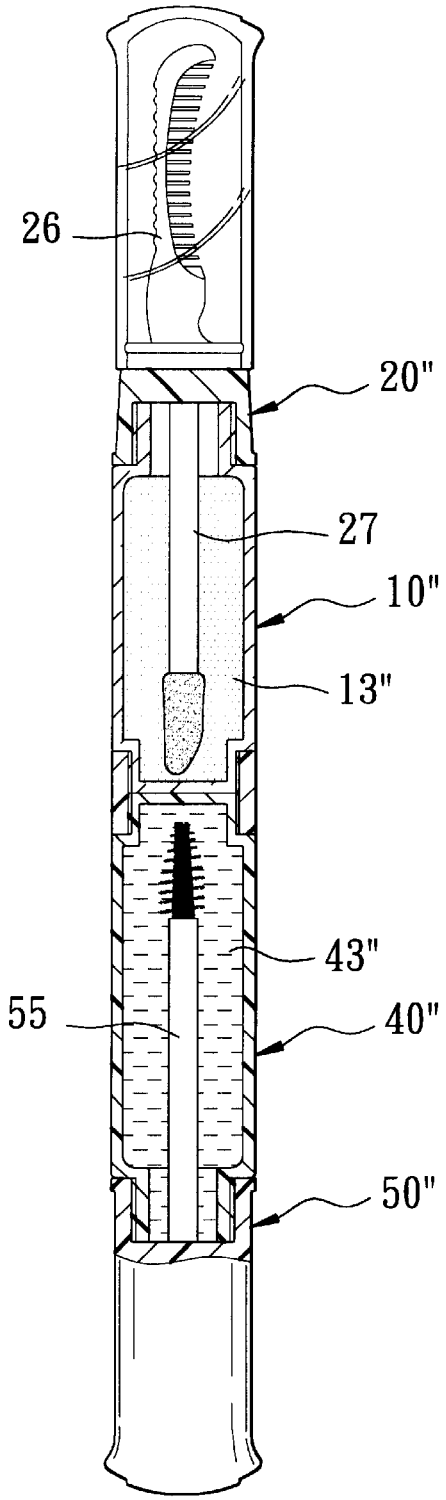
FIG. 8 is an assembled partly sectional schematic view of the third preferred embodiment of a multi-purpose pen-shaped container according to the present invention.

FIG. 8 illustrates the third preferred embodiment of a multi-purpose pen-shaped container according to the present invention. In this embodiment, the first receiving chamber 13" in the first receptacle body 10" is filled with lip gloss. The first and third cosmetic applicators of the first applicator device 20" are an eyebrow comb 26 and a sponge-tip applicator 27, respectively. The second receiving chamber 43" in the second receptacle body 40" is filled with mascara. The second cosmetic applicator of the second applicator device 50" is a third brush applicator 55.

It has thus been shown that the multi-purpose pen-shaped container of the present invention is not only suitable for holding a variety of cosmetic products, but is also convenient to carry. Furthermore, the pen-shaped container is convenient to use since it has an adequate length to facilitate handling when applying make-up.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A multi-purpose pen-shaped container comprising:

an elongate first receptacle body having a first receptacle axis, first and second end portions opposite to each other along said first receptacle axis, and a peripheral wall that extends between said first and second end portions and that is disposed to surround said first receptacle axis so as to define a first receiving chamber, said first end portion being a closed end portion and having an outer surface formed with a first coupling member, said second end portion being an open end portion that permits access into said first receiving chamber and having an outer surface formed with a first connecting member;

a first applicator device having a base portion formed with a second connecting member to engage said first connecting member such that said base portion of said first applicator device closes said second end portion of said first receptacle body, and a first cosmetic applicator mounted on said base portion;

an elongate first end cap having a tubular cap wall that is capped removably on said base portion of said first applicator device and that cooperates with said base portion of said first applicator device to define a first receiving space for receiving said first cosmetic applicator therein;

an elongate second receptacle body having a second receptacle axis, first and second end portions opposite to each other along said second receptacle axis, and a peripheral wall that extends between said first and second end portions of said second receptacle body and that is disposed to surround said second receptacle axis so as to define a second receiving chamber, said first end portion of said second receptacle body being a closed end portion and having an outer surface formed with a second coupling member, said second end portion of said second receptacle body being an open end portion that permits access into said second receiving chamber and having an outer surface formed with a third connecting member;

a second applicator device having a base portion formed with a fourth connecting member to engage said third connecting member such that said base portion of said second applicator device closes said second end portion of said second receptacle body, and a second cosmetic applicator mounted oh said base portion of said second applicator device;

a coupling unit disposed to surround said first end portions of said first and second receptacle bodies and formed with a third coupling member to engage removably said first and second coupling members such that said first receptacle axis is brought into alignment with said second receptacle axis; and third cosmetic applicator that is mounted on said base portion and that extends into a respective one of said first and second receiving chambers, the third cosmetic applicator being included in at least one of said first and second applicator devices.

2. The multi-purpose pen-shaped container as claimed in claim 1, wherein each of said first and second coupling members is an external screw thread, and said third coupling member is an internal screw thread.

3. The multi-purpose pen-shaped container as claimed in claim 1, further comprising an elongate second end cap having a tubular cap wall that is capped removably on said base portion of said second applicator device and that cooperates with said base portion of said second applicator device to define a second receiving space for receiving said second cosmetic applicator therein.

4. The multi-purpose pen-shaped container as claimed in claim 3, wherein at least one of said first and second end caps has an end wall with a mirror mounted thereon.

5. The multi-purpose pen-shaped container as claimed in claim 1, wherein at least one of said first and second cosmetic applicators is one of a stylus nib that is in fluid communication with a respective one of said first and second receiving chambers, a lipstick, an atomizer that is in fluid communication with a respective one of said first and second receiving chambers, and an eyebrow comb.

6. The multi-purpose pen-shaped container as claimed in claim 1, wherein said third cosmetic applicator is one of a brush applicator and a sponge-tip applicator.

7. The multi-purpose pen-shaped container as claimed in claim 1, wherein each of said first and second receiving chambers is adapted to be filled with one of nail polish, polish remover, lip gloss, perfume, and mascara.

* * * * *